United States Patent [19]

van Geest et al.

[11] 4,307,130

[45] Dec. 22, 1981

[54] METHOD OF MAKING THE CATHODE OF A DIODE IMAGE INTENSIFIER TUBE

[75] Inventors: Lambertus K. van Geest, Roden; Johannes J. Houtkamp, Delft, both of Netherlands

[73] Assignee: NV Optische Industrie "De Oude Delft", Netherlands

[21] Appl. No.: 105,024

[22] Filed: Dec. 19, 1979

Related U.S. Application Data

[62] Division of Ser. No. 926,252, Jul. 20, 1978, Pat. No. 4,243,905.

[30] Foreign Application Priority Data

Jul. 27, 1977 [NL] Netherlands ..... 7708321

[51] Int. Cl.[3] ..... H01J 43/28

[52] U.S. Cl. ..... 427/70; 429/77; 429/78; 313/94; 313/102

[58] Field of Search ..... 313/94, 99, 102; 427/77, 78, 69, 70

[56] References Cited

U.S. PATENT DOCUMENTS

| | | | |
|---|---|---|---|
| 2,431,401 | 11/1947 | Janes | 313/102 |
| 3,375,391 | 3/1968 | Day | 313/102 |
| 3,662,206 | 5/1972 | Fleck | 313/94 |
| 3,688,146 | 8/1972 | Bouwers | 313/102 |
| 3,916,240 | 10/1975 | Cuelenaere et al. | 313/102 |
| 3;989,971 | 11/1976 | Santilli | 313/102 |

*Primary Examiner*—Ralph S. Kendall

*Attorney, Agent, or Firm*—Louis E. Marn; Elliot M. Olstein

[57] ABSTRACT

A method of making the cathode of a diode image intensifier tube by evaporating some alkali metals and antimony on to the inner surface of a cathode window which by means of a layer of frit is joined to a metallic cathode flange, and in which there is provided between the cathode and the cathode flange, or, as the case may be, the cathode housing, an electrical resistance of a pre-determined value such that at light levels at which there is a danger of the anode being burnt, the diode image intensifier tube is defocussed or cut off, and wherein prior to the evaporation of the metals an alkali-resistant and insulating layer is applied to the frit layer, and that the evaporation of the antimony is carried out so that there is formed between the cathode and the cathode flange an area extending around the cathode and where no antimony is present, and that at least one galvanic connection is passed vacuum-tight outside the diode image intensifier tube, and one end of said connection is arranged at the place of the cathode to be formed for supplying voltages of a pre-determined magnitude to the cathode during its manufacture and later during operation of the tube.

15 Claims, 14 Drawing Figures

METHOD OF MAKING THE CATHODE OF A DIODE IMAGE INTENSIFIER TUBE

This is a division, of application Ser. No. 926,252, filed July 20, 1978 U.S. Pat. No. 4,243,905.

This invention relates to a method of making the cathode of a diode image intensifier tube by evaporating some alkali metals and antimony on to the inner surface of a cathode window which by means of a frit layer is joined to a metallic cathode flange, there being arranged between the cathode and the cathode flange, or, as the case may be, the cathode housing, an electrical resistor having a pre-determined value such that at light levels at which there is a danger of the anode being burnt, the diode image intensifier tube is defocussed or cut off.

According to generally known methods of making a cathode of a diode image intensifier tube, a number of metals, such as for example potassium, sodium, cesium and antimony are evaporated on to the inner surface of the cathode window. Furthermore, during the manufacture of the cathode, the photo current within the tube is continuously measured. For it can be seen from the variation in this photo current whether the evaporation of a metal is to be continued or can be terminated.

If these prior methods such as disclosed in U.S. Pat. No. 3,916,240 are used for manufacture of a cathode of a diode image intensifier tube on the inner surface of a cathode window which by means of a frit layer is joined to a metallic cathode flange, coupled to the cathode housing, an electrical resistor having such a value that at light levels at which there is a danger of the anode being burnt the diode image intensifier tube is defocussed or cut off, a number of problems present themselves.

Thus the value of the resistance of the layer formed by the evaporated metals on the frit layer, i.e., of the layer formed in fact between the cathode proper and the cathode flange, turns out to be considerably lower than the pre-determined value required for the diode image intensifier tube to be de-focussed or cut off at light values at which there is a danger for the anode being burnt. For solving this problem it has been found that it is not sufficient to take such measures as to prevent for example, the antimony from depositing on the frit layer. For in that case only alkali metal vapours could come into contact with the frit layer, and as could be expected, no electrically conductive layer would form. Remarkably, however, it turns out that under these conditions an electrically conductive layer is formed all the same. It is assumed that this electrically conductive layer is formed from a chemi-al reaction between the alkali metals and the frit.

It is an object of the present invention to provide a method of making the cathode of a diode image intensifier tube by evaporating some alkali metals and antimony on to the inner surface of a cathode window which by means of a frit layer is connected to a metallic cathode flange coupled to the cathode housing, an electrical resistance of a pre-determined value such that at light levels at which there is a danger for the anode to be burnt, the diode image intensifier tube is defocussed or cut off, whereby the formation of an electrically conductive layer consisting of evaporated metals between the cathode and the cathode flange of undesirably low resistance value is prevented.

The method of this kind is characterized, according to the invention, in that prior to the evaporation of the metals an alkali-resistant and insulating layer is applied to the frit layer, and that the evaporation of the antimony is carried out so that there is formed between the cathode and the cathode flange an area extending around the cathode and where no antimony is present.

According to a different aspect of the present invention, the method of the above kind is characterized in that the thickness of the alkali-resistant and insulating layer is selected so that an electrically conductive layer is formed by chemical reaction between the alkali metals and the frit, the resistance value of said insulating layer being substantially equal to, or higher than, said pre-determined resistance value.

According to still another aspect of the invention, the method according to the invention is characterized in that at least one galvanic connection is passed vacuum-tight outwards of the diode image intensifier tube, and one end of which is arranged at the position of the cathode to be formed, in order that voltages of a predetermined magnitude may be supplied to the cathode during manufacture and subsequently during operation of the tube.

It is noted that the provision of this galvanic connection offers the possibility, in addition to measuring the photo current during the evaporation, of externally connecting a shunt resistor between the cathode and the cathode flange, or, as the case may be, the cathode housing, in case the layer formed between the cathode and the cathode flange has substantially the given resistance value, or a much higher value, in order that the resistance between the cathode and the cathode flange or the cathode housing may be adjusted to the value required for the diode image intensifier tube to be defocussed or cut off at light levels at which there is a danger of the anode being burnt.

Some embodiments of the present invention will now be described, by way of example, with reference to the accompanying drawings, in which FIG. 1 shows an elevational view of a cathode window for an image intensifier tube according to the present invention;

Figure 1:
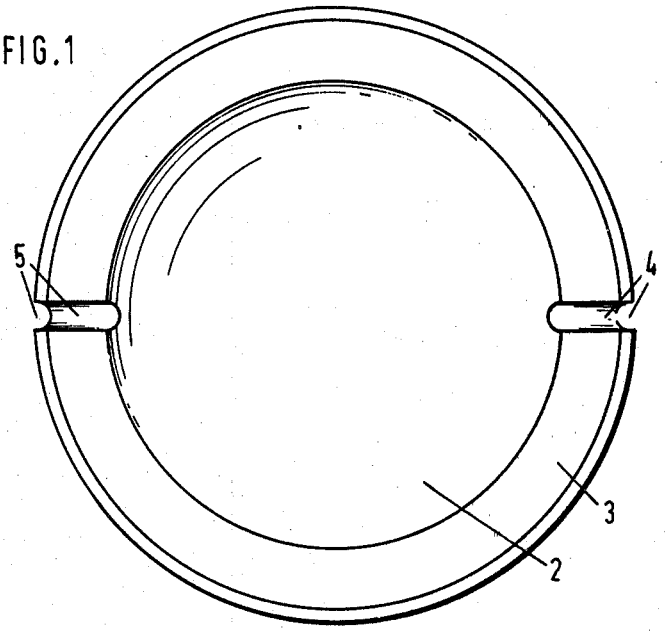
Figure 2:
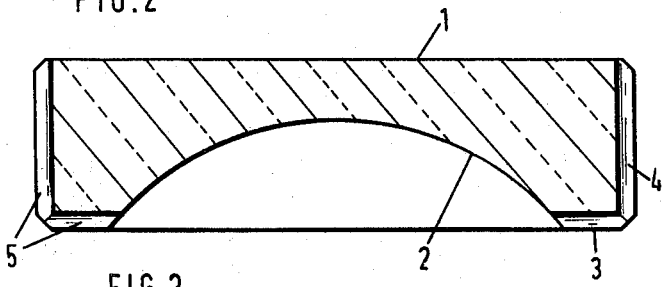
FIG. 2 shows a cross-sectional view of the cathode window of FIG. 1.
Figure 3:
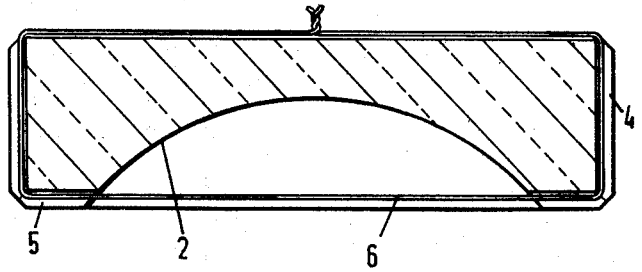
FIG. 3 shows a cathode window provided with an electrical conductor.
Figure 4:
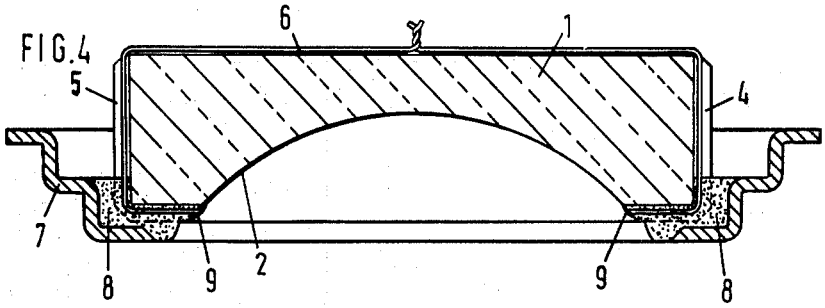
FIG. 4 shows a cathode window joined to a cathode flange by means of frit.

FIGS. 1 and 2 show a cathode window for an image intensifier tube. The window, which may be made of glass or of an optical fibre plate, has an input face 1 and a curved cathode area 2. On the cathode area, the cathode is to be formed. Furthermore the window has around the cathode area a flat portion 3. Formed in this flat portion 3 are grooves 4 and 5, which extend into the side surface of the cathode window. Grooves 4 and 5 serve to receive a conductor which during the formation of the cathode serves to measure the photo current. For this purpose, the conductor can be laid in grooves 4 and 5, and its ends can be knotted together for the time being. FIG. 3 shows a cross-sectional view of a cathode window provided with a conductor 6, installed in the manner described. FIG. 4 shows the cathode window provided with a conductor and secured through a layer of frit to a cathode flange 7. Frit layer 8 also retains conductor 6. The part of conductor 6 bridging the cathode area is now cut through, and the remaining ends are severed to the surface of the frit layer. Subsequently, a little-bit of electrically conductive paste, e.g. silver paste, is applied to both ends to ensure proper contact with the cathode to be formed.

Figure 5:
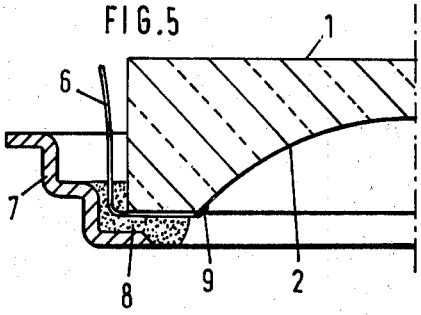
FIGS. 5 and 6 show two other possibilities of mounting an electrical conductor.
Figure 6:
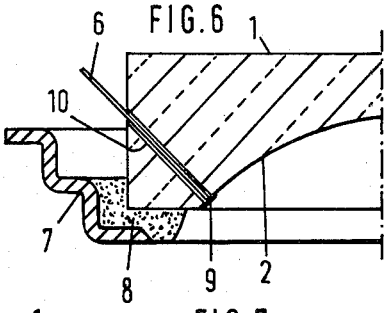

It is noted that the conductor can also be installed in a different manner. Thus the conductor may be arranged to extend fully through the frit layer, or through the cathode window only, via a passage drilled in the cathode window. In the latter case, the conductor is passed vacuum-tight by means of a frit joint through the passage in the cathode window. The two possibilities indicated are shown in FIGS. 5 and 6. Passage 10 can be drilled ultrasonically both before and after the cathode window has been secured to the cathode flange.

Another possibility of installing a conductor is to provide the cathode window, before it is connected to the cathode flange, with an electrically conductive strip extending over the flat portion 3 and the side, which path is formed for example by evaporating metals or applying a conductive emulsion, such as silver paste or silver paint.

After the cathode window has been provided, in any of the manners described, with at least one conductor for measuring the photo current during the formation, and after the cathode window has been frit-joined to the cathode flange, an alkali-resistant and insulating layer, consisting for example of chromium diode and water glass, is applied to the frit layer. This can be done by painting a suspension of chromium oxide in potassium waterglass solution with a brush. Subsequently, the alkaline materials can be applied by evaporation in vacuo.

If, after the evaporation of the alkaline substances, materials must be evaporated that could form a conductive layer between the photocathode and the cathode flange, preferably an annular shield is placed on the cathode flange before the evaporation of the alkaline substances. This shield may be secured to the cathode flange, for example, by spot welding. The shield should extend from the cathode flange inwardly to adjacent the photocathode, so that at any rate the frit layer, and preferably part of the cathode window, too, is covered.

Figure 7:
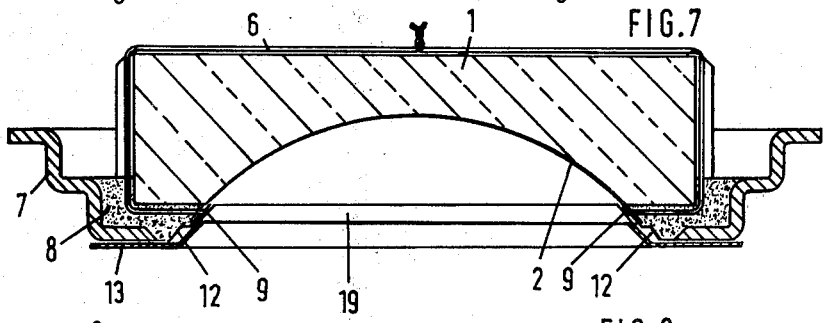
FIG. 7 shows a cathode window secured to a cathode flange, with a shield being mounted on the cathode flange.

All this is shown in FIG. 7, which shows a cathode window 1, which by means of a frit layer 8 is connected to a cathode flange 7. Conductor 6 has been installed in the manner described, and connected by means of an electrically conductive paste 9, e.g. silver paste, to a metallic film, e.g. an aluminum film, serving to ensure proper electrical contact with the cathode to be formed. Applied to the layer of frit 8 is a layer of chromium oxide 12.

Furthermore, an annular shield 13 is secured to cathode flange 7. Shield 13 extends parallel to the flat portion of the cathode window inwardly to beyond the frit layer, and is then preferably bent towards the cathode area, approximately parallel to the edge zone of the cathode area to terminate short of the cathode area. The frit layer is now protected by the chromium oxide 12 against the effect of alkali vapours, while the layer of chromium oxide is in turn protected from substances, such as antimony, that might form a conductive layer between the cathode flange and the silver contacts 9, as well as the aluminum layer 11. Under the conditions prevailing during the evaporation, the vapour pressure of the antimony is so low that the antimony atoms cannot penetrate into the space between the frit layer and shield 13. As a result of the measures described, the cathode flange remains effectively electrically insulated from the cathode.

An alternative was of maintaining an electrically insulating area between the cathode flange and the cathode consists, according to the present invention, in providing a groove in the cathode window, surrounding the cathode area, or an elevation on the cathode window, surrounding the cathode area. In all cases, the aim is to produce such a configuration as to provide a shadowed area or a lee. In the shadowed area, the conductive substance is then prevented from depositing, so that an insulating area surrounding the cathode area is maintained.

Figure 8:
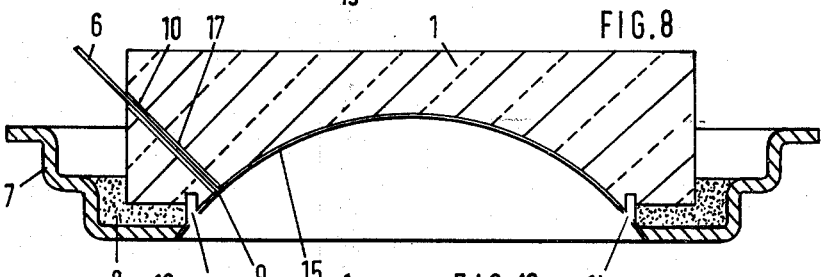
FIG. 8 shows a cathode window provided with a groove according to the present invention.
Figure 9:
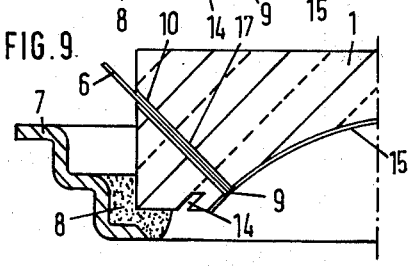
FIGS. 9 and 10 show alternative forms of the groove of FIG. 8.

FIG. 8 shows an embodiment of a cathode window provided with a groove 14. As the antimony is evaporated from a source disposed approximately in the centre of curvature of the inner surface of the cathode window, the inner wall of the groove remains free of antimony. In the embodiment shown, the conductor 6 is passed through a channel 10 in the cathode window and connected at the end of channel 10 with the cathode area by means of a silver dot 9. Conductor 9 is secured within channel 10, for example, by means of a layer of frit 17. The end of channel 10 lies within the area enclosed by groove 14. By virtue of this arrangement, it is in principle not necessary to deposit chromium dioxide on the frit layer, as the groove ensures that both conductor 6 and the cathode remain insulated relative to the frit layer and the cathode flange.

Figure 10:
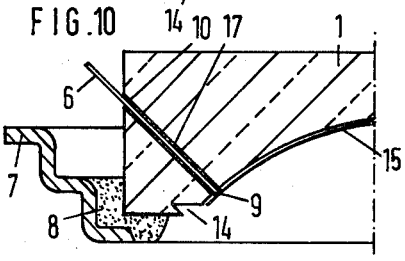

It is noted that the groove may have various configurations. Two alternative possibilities are shown in FIGS. 8 and 10.

It is further observed that when a shield 13 is used it is in principle not necessary to deposit chromium oxide on the frit layer either, provided conductor 6 is not in contact with the frit layer, and provided a sufficiently large insulating area is maintained between the frit layer and the edge of the photocathode 15. This latter depends on the dimensions of the shield.

Figure 11:
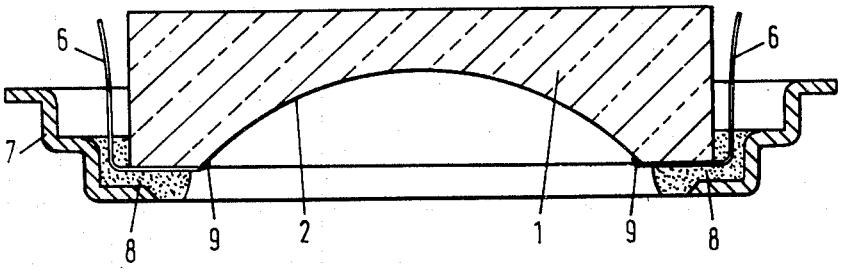
FIG. 11 shows the cathode side of an image intensifier tube.

FIG. 11 shows a cathode window 1 which by means of a frit layer 8 is connected to a cathode flange 7. The photocathode is to be formed on the curved inner surface 2 of the cathode window. In the configuration shown, two conductors 6 are connected to the inner surface 2. To this end, the ends of the conductors are broken off to the surface of the frit layer, and secured with a dot of silver paste 9. Conductors 9 can rest against the surface of the cathode window and are then fixed by frit layer 8.

Figure 12:
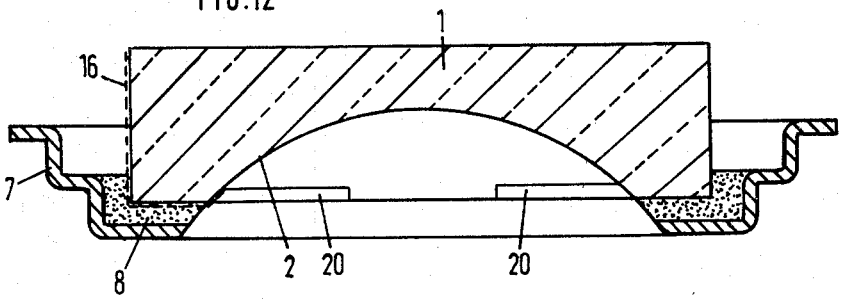
FIG. 12 shows a cathode window provided in an alternative manner with a conductor.

FIG. 12 shows another possibility of providing a conductor connected to the cathode area. In this instance, an electrically conductive strip 16 is formed at one or more places on the cathode window, for example, by evaporating metals or applying conductive emulsion, such as silver paste or silver paint. The strip may follow, for example, the configuration of the conductor shown in FIG. 11. The conductive emulsion should be resistant to the further processing to which the cathode window is subjected during the manufacture of the image intensifier tube. The conductor formed in this manner can be connected in known manner, for example, by soldering, to a self-supporting conductor.

Figure 13:
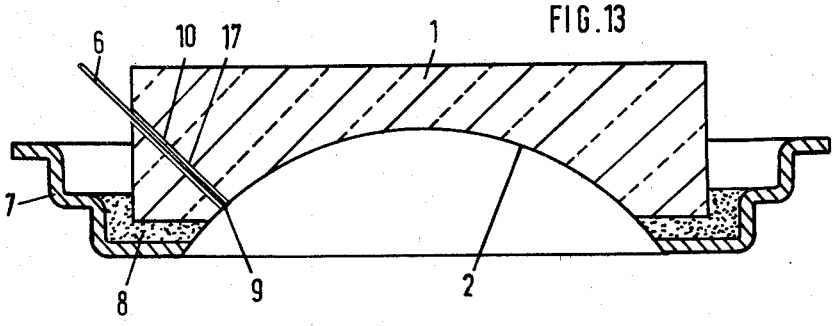
FIG. 13 shows still another manner of providing a cathode window with a conductor.
Figure 14:
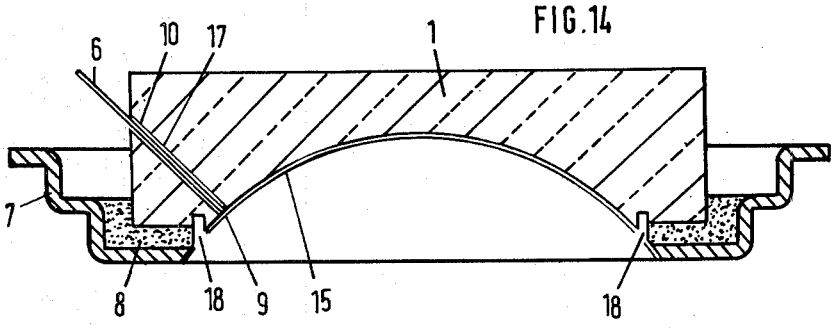
FIG. 14 shows a practical application of the configuration of FIG. 13.

FIG. 13 shows still another possibility of providing a cathode window with a conductor connected to the cathode area. A passage 10 has been drilled into the cathode window, taking account of the fact that the incidence of light through the window on to the cathode must not be interfered with. The passage terminates at one end at the edge of the cathode area, and at the other end in the sidewall of the cathode window above frit layer 8. Passed through passage 10 is a conductor 6. The end of the conductor located adjacent to the cathode area is again ground flat and provided with a dot 9 of conductive material, e.g. a silver dot, to ensure proper electrical contact with the photocathode to be formed. Conductor 6 is, for example, by means of a frit joint 17, embedded vacuum-tight in passage 10. This embodiment is in particular advantageous if a groove is formed in the cathode window at the edge of the cathode area for the cathode flange to be electrically insulated from the cathode area. All this is shown in FIG. 14, which shows a cathode window 1 provided with a circumferential groove 18. Passage 10 terminates within the area enclosed by groove 18.

In all of the embodiments described, there may be one or more conductors mounted in the manner described. Furthermore, a metallic ring, e.g. an aluminum ring, may be evaporated at the circumference of the cathode area, which ring covers the silver dot(s) and still further improves the electrical contact between the conductor(s) and the cathode to be formed or already formed. An aluminum ring entirely surrounding the cathode is shown in FIG. 7 at 19, and an open ring partially surrounding the cathode at 20 in FIG. 12.

It should be noted that various modifications of the methods and image intensifier tubes described will readily occur to those skilled in the art without departing from the scope of the present invention.

We claim:

1. In a method for making a cathode of a diode image intensifier tube wherein alkali metals and antimony are evaporated onto an inner surface of a cathode window and wherein said cathode window is joined by a layer of frit to a metallic cathode flange coupled to a cathode housing, said diode image intensifier tube having between said cathode window and said metallic cathode flange an annular area of electrical resistance of a predetermined value such that at light levels whereat there is a danger of anode burn out, said diode image intensifier tube is caused to be defocussed or cut off, the improvement characterized by positioning at least one galvanic connector through said diode image intensifier tube and insulated from said metallic cathode flange with one end of said galvanic connector extending out of said diode image intensifier tube and the other end being in contact with said inner surface of said cathode window for supplying voltages of a pre-determined magnitude to said cathode during its manufacture and during operation of said tube.

2. The method according to claim 1 wherein said galvanic connector is an electrical conductor.

3. The method according to claim 2 wherein said electrical conductor is retained by said layer of frit.

4. The method according to claims 2 or 3 wherein a groove is formed in a sidewall and an edge of said cathode window, and said conductor is positioned within said groove.

5. The method according to claim 2 wherein at least one continuous strip of an electrically conductive material is formed on a side surface of said cathode window and between said surface and said cathode.

6. The method according to claim 5 wherein said continuous strip is formed by evaporating alkali metals.

7. The method according to claim 5 wherein said continuous strip is formed by applying a conductive emulsion.

8. The method according to claim 7 wherein said conductive emulsion is a silver-containing paste.

9. The method according to claim 2 wherein a passage is drilled in said cathode window for installing said electrical conductor, said passage being terminated at an end at an edge of said cathode, and at the other end in the surface of said cathode window located outside said diode image intensifier tube, and said conductor being secured in said passage in a vacuum-tight manner.

10. The method according to claim 9 wherein said electrical conductor is secured in said passage in a vacuum-tight manner by means of a layer of frit.

11. The method according to claim 10 wherein said electrical conductor is installed such that its end is coplanar with the surface of said cathode window at such point.

12. The method according to claim 2 and including two electrical conductors and wherein an end of each of said electrical conductors located adjacent to said cathode is provided with an electrically conductive material to promote electrical contact.

13. The method according to claim 12 wherein said electrically conductive material is silver.

14. The method according to claim 2 wherein at least a portion of a metallic ring is provided around said cathode and wherein said end of said electrical conductor located adjacent to said cathode is brought into electrical contact with said ring portion.

15. The method according to claim 14, wherein said metallic ring is an aluminum ring.

* * * * *